US009828727B2

(12) United States Patent
Kosonen et al.

(10) Patent No.: US 9,828,727 B2
(45) Date of Patent: Nov. 28, 2017

(54) METHOD FOR PREPARING FURNISH AND PAPER PRODUCT

(71) Applicant: UPM-Kymmene Corporation, Helsinki (FI)

(72) Inventors: Mika Kosonen, Lappeenranta (FI); Mika Raty, Saimaanharju (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 0 days.

(21) Appl. No.: 14/916,272

(22) PCT Filed: Sep. 22, 2014

(86) PCT No.: PCT/FI2014/050721
§ 371 (c)(1),
(2) Date: Mar. 3, 2016

(87) PCT Pub. No.: WO2015/044520
PCT Pub. Date: Apr. 2, 2015

(65) Prior Publication Data

US 2016/0201265 A1 Jul. 14, 2016

(30) Foreign Application Priority Data

Sep. 27, 2013 (FI) ..... 20135970

(51) Int. Cl.

| | |
|---|---|
| ***D21H 17/66*** | (2006.01) |
| ***D21H 11/18*** | (2006.01) |
| ***D21H 17/25*** | (2006.01) |
| ***D21H 17/29*** | (2006.01) |
| ***D21H 21/10*** | (2006.01) |
| ***D21H 23/04*** | (2006.01) |

(52) U.S. Cl.
CPC ..... *D21H 11/18* (2013.01); *D21H 17/25* (2013.01); *D21H 17/29* (2013.01); *D21H 17/66* (2013.01); *D21H 21/10* (2013.01); *D21H 23/04* (2013.01)

(58) Field of Classification Search
CPC ..... D21H 11/18; D21H 17/25; D21H 17/29; D21H 17/66; D21H 23/04; D21H 21/10
USPC ..... 162/175
See application file for complete search history.

(56) References Cited

U.S. PATENT DOCUMENTS

| | | | |
|---|---|---|---|
| 2013/0180680 | A1 | 7/2013 | Axrup et al. |
| 2015/0218756 | A1 | 8/2015 | Kosonen et al. |

FOREIGN PATENT DOCUMENTS

| | | | |
|---|---|---|---|
| CN | 102080342 | A | 6/2011 |
| EP | 2639351 | A1 | 9/2013 |
| JP | 11200282 | | 7/1999 |
| JP | 201174528 | A | 4/2011 |
| WO | 2012098296 | A2 | 7/2012 |
| WO | 2013072550 | A2 | 5/2013 |
| WO | 2014029916 | A1 | 2/2014 |

OTHER PUBLICATIONS

International Search Report mailed Jan. 8, 2015; International Application No. PCT/FI2014/050721; International filing Date Sep. 22, 2014 (4 pages).

Written Opinion mailed Jan. 8, 2015; International Application No. PCT/FI2014/050721; International filing Date Sep. 22, 2014 (6 pages).

Kutcharlapati, S. et al. "Influence of Nano Cellulose Fibres on Portland Cement Matrix", Metal Materials and Processes, 2008, vol. 20, No. 3, pp. 307-314.

*Primary Examiner* — Mark Halpern
(74) *Attorney, Agent, or Firm* — Cantor Colburn LLP

(57) ABSTRACT

The invention relates to a method for preparing aqueous furnish to be used in paper product manufacturing. In the method aqueous furnish is prepared by making a fiber suspension, and cationic natural polymer (S), alum (A) and anionic nanofibrillar cellulose (F) are added to the aqueous furnish in a short circulation of a paper or board machine.

8 Claims, 12 Drawing Sheets

| | | | | | |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

| | | | | | |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

| | | | | | |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

| | Ref. | F | FS | FS | FSA |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

| | Ref. | F | FS | FS | FSA |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

| | Ref. | F | FS | FS | FSA |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

| | Ref. | F | FS | FS | FSA |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

| | Ref. | F | FS | FS | FSA |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

| | Ref. | F | FS | FS | FSA |
|---|---|---|---|---|---|
| C-PAM, g/t | 150 | 150 | 150 | 0 | 0 |
| NFC, kg/t | 0 | 8 | 8 | 8 | 8 |
| cat. Starch, kg/t | 0 | 0 | 8 | 8 | 8 |
| Alum, kg/t | 0 | 0 | 0 | 0 | 2 |

METHOD FOR PREPARING FURNISH AND PAPER PRODUCT

CROSS-REFERENCE TO RELATED APPLICATIONS

This application is a National Stage application of PCT/FI2014/050721, filed Sep. 22, 2014, which claims the benefit of Finnish Application No. 20135970, filed Sep. 27, 2013, both of which are incorporated by reference herein in their entirety.

FIELD OF THE INVENTION

The present invention relates to a method for preparing aqueous furnish to be used in paper product manufacturing. The present invention also relates to a paper product. The present invention further relates to an improved retention system.

BACKGROUND OF THE INVENTION

Poor retention of the filler in the paper results in increased contents of the filler in circulation waters of the papermaking process, which may cause problems in the process. Use of chemical retention aids, such as c-PAM (cationic polyacrylamide) has its limits too. cPAM is an aggressive flocculation polymer that may easily lead to formation problems in form of strong flocculation.

Another problem related to the large filler proportions is the weakening of the mechanical properties of the paper product, because the fillers interfere with the bonds between the fibres which create the structural integrity of the paper product mainly by means of hydrogen bonds between cellulose molecules. Neither does cPAM have any strengthening or densifying effect on paper properties.

Both the poor retention of the filler and weakened mechanical properties of the paper product are due to poor fiber-filler bond in the fibrous network.

SUMMARY OF THE INVENTION

Thus, there is a need for a novel method where the filler proportion could be raised in a manner which allows the filler particles to be retained in the network of the fibres, without affecting the strength properties of the paper product too much, by increasing the affinity of the filler towards the fibrous network. There is also need for a novel method for improving the retention system in general without the use of cPAM.

It is an aim of the present invention to provide a novel method for preparing aqueous furnish to be used in paper and paper board manufacturing in such a way that the paper product manufactured from the furnish has a high loading of filler, with good mechanical strength. The aim of the invention is also to provide a novel method for preparing a furnish in order to improve the interactions between fibres and fillers, and to solve the problem caused by adding cPAM. The aim is also to develop the retention system of papermaking in general, irrespective of whether fillers are used or not.

According to the method, cationic natural polymer, alum and anionic nanofibrillar cellulose (NFC) are added into furnish. The furnish comprises fibres and it may comprise also filler.

The alum (aluminium sulfate), cationic natural polymer and the anionic nanofibrillar cellulose form an effective retention system, where the aluminium sulfate acts as coagulant and the anionic nanofibrillar cellulose as microparticles. The cationic natural polymer acts as cationic retention agent and as dry strength additive.

The cationic natural polymers include unmodified natural polymers and derivatives of natural polymers. The derivatives are made by chemical modification of the functional groups of the polymer chain. The derivatives can be cationically modified polysaccharides, of which cationic starch and cationic nanofibrillated cellulose are examples. Chitosan is another example of a cationically modified polysaccharide. Different cationic natural polymers can be used in mixture, for example both cationic starch and may be used together in the same furnish.

According to one aspect of the method, an aqueous furnish to be used in paper product manufacturing is prepared by making a fibre suspension in water, and alum, anionic nanofibrillar cellulose and cationic natural polymer are added to the aqueous furnish. These substances are added to the fibre suspension, which possibly contains filler, in the short circulation of a paper machine. The alum, anionic nanofibrillar cellulose and cationic natural polymer are added to the flow of aqueous furnish before the aqueous furnish is transferred into a head box in a paper machine.

In a preferred embodiment, alum and cationic natural polymer is added to the furnish before the anionic nanofibrillar cellulose is added.

Advantageously, alum and cationic natural polymer are added in the short circulation before the aqueous furnish is transferred to a feed pump in a paper machine, and the anionic nanofibrillar cellulose is added to the aqueous furnish after the aqueous furnish has passed through a pressure screen.

Alternatively, the cationic natural polymer is added in the short circulation before anionic nanofibrillar cellulose is added, followed by adding alum.

In a preferred embodiment, the cationic natural polymer is added in the short circulation before the aqueous furnish is transferred to a feed pump of a paper machine, and alum and anionic nanofibrillar cellulose are added to the aqueous furnish after the aqueous furnish has passed through a pressure screen of the paper machine.

A paper product is manufactured from furnish comprising at least fibre, alum, cationic natural polymer and anionic nanofibrillar cellulose. The paper product is manufactured by removing water from the fibre suspension comprising the above-mentioned additives which are added in any order indicated in this disclosure, and possibly filler. The paper product so manufactured comprises at least fibres, alum, cationic natural polymer and anionic nanofibrillar cellulose, and possibly also filler. In this context, term "paper product" shall be understood to include also products commonly indicated as "paperboard" or "board", that is, the term is not limited to a particular basis weight. Likewise, the term "paper machine" used in this disclosure is to interpreted to comprise also board machines.

In one embodiment, the furnish may comprise 0.1-30 kg/t, preferably 0.5-15 kg/t (as dry based on dry total weight of furnish) anionic NFC, 0.1-30, preferably 1-15, most preferably 1.5-10 kg/t cationic natural polymer, and 0.1-5, preferably 0.5-3, most preferably 0.6-2.5 kg/t alum.

Thus, a retention system is provided for making paper product, wherein cationic natural polymer, alum and anionic nanofibrillar cellulose are used.

DETAILED DESCRIPTION OF THE INVENTION

Figure 1:
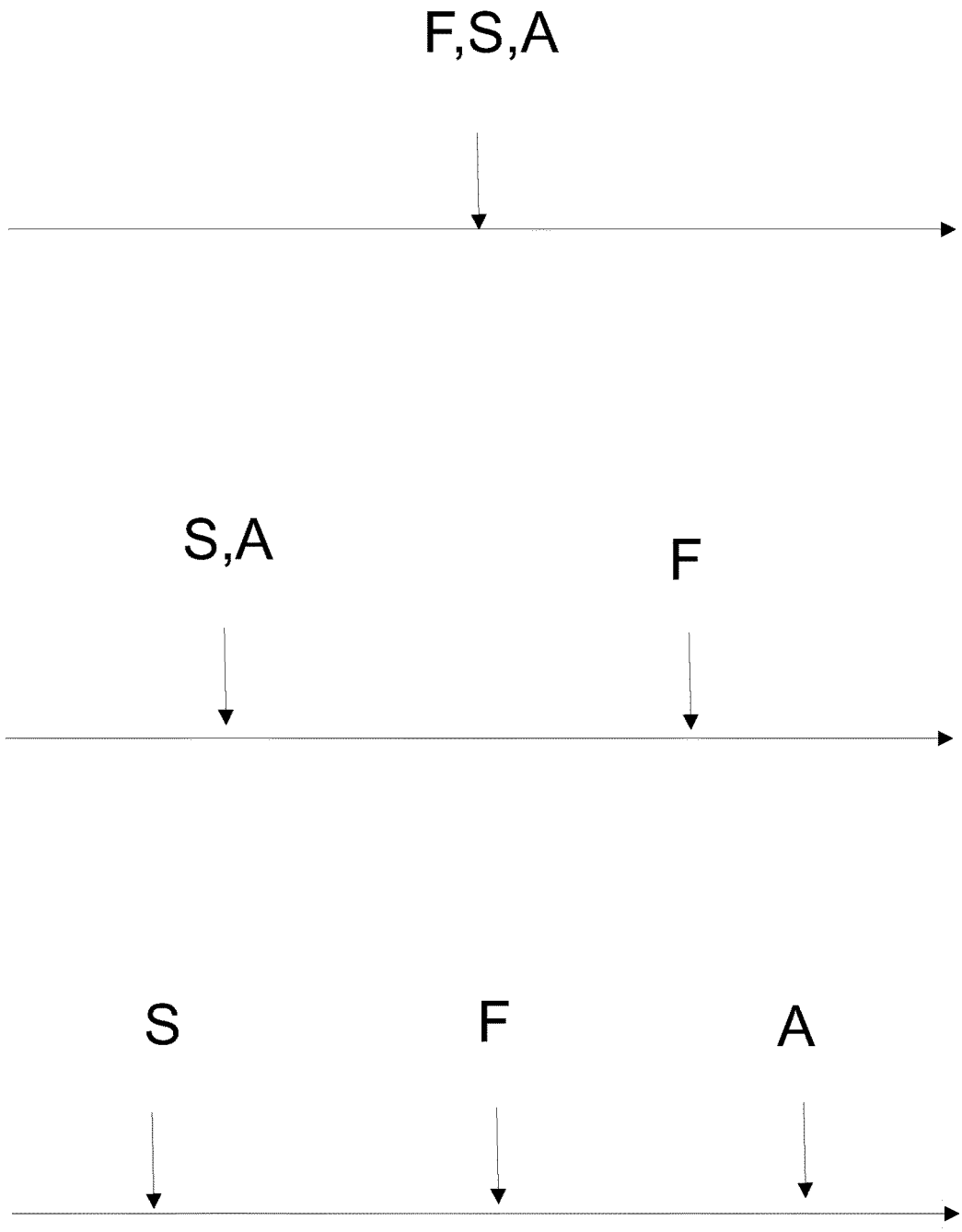
FIG. 1 illustrates exemplary methods of the present solution, wherein reference symbol F refers to anionic nanofibrillar cellulose (NFC), reference symbol S refers to cationic natural polymer (in the examples cationic starch or cationic NFC), and reference symbol A refers to alum (aluminium sulfate). The arrow refers to the procedure of transferring furnish from a machine chest to forming section paper machine, after dilution with white water, i.e. it represents the short circulation of a paper machine.

In the following disclosure, all percent values are by weight, if not indicated otherwise. Further, all numerical ranges given include the upper and lower values of the ranges, if not indicated otherwise.

Traditional retention system in a paper machine is based on a cationic polymer, such as c-PAM, and possibly one or more other components. Typically the additional component is anionic, such as bentonite or silica.

C-PAM is an aggressive flocculation polymer that easily leads to formation problems in form of strong flocculation. The c-PAM has not any strengthening or densifying effect on paper properties either.

In the present method, cationic polymer and its anionic counterpart may be replaced with alum and anionic microparticles which are anionic nanofibrillar cellulose, by adding still cationic natural polymer, such as cationically modified polysaccharide, which may be cationic starch and/or cationic nanofibrillar cellulose.

In other words, the long-term existing problem caused by using c-PAM as retention aid is solved by the present method. In addition, adding cationic natural polymer, such as cationically modified polysaccharide, and alum and anionic nanofibrillar cellulose has a synergistic effect on paper properties.

Nanofibrillar Cellulose (NFC)

The term nanofibrillar cellulose refers to a collection of isolated cellulose microfibrils or microfibril bundles derived from cellulose raw material.

Nanofibrillar cellulose have typically high aspect ratio: the length might exceed one micrometer while the number-average diameter is typically below 200 nm. The diameter of nanofibril bundles can also be larger but generally less than 5 μm. The smallest nanofibrils are similar to so called elementary fibrils, which are typically 2-12 nm in diameter. The dimensions of the fibrils or fibril bundles are dependent on raw material and disintegration method. The nanofibrillated cellulose may also contain some hemicelluloses; the amount is dependent on the plant source. Mechanical disintegration of nanofibrillar cellulose from cellulose raw material, cellulose pulp, or refined pulp is carried out with suitable equipment such as a refiner, grinder, homogenizer, colloider, friction grinder, ultrasound sonicator, fluidizer such as microfluidizer, macrofluidizer, or fluidizer type homogenizer.

Nanofibrillar cellulose can also be directly isolated from certain fermentation processes. The cellulose-producing micro-organism of the present invention may be of the genus *Acetobacter, Agrobacterium, Rhizobium, Pseudomonas* or *Alcaligenes*, preferably of the genus *Acetobacter* and more preferably of the species *Acetobacter xylinum* or *Acetobacter pasteurianus*. Nanofibrillated cellulose can also be any chemically, enzymatically or physically modified derivate of cellulose microfibrils or microfibril bundles. The chemical modification could be based for example on carboxymethylation, oxidation, esterification, or etherification reaction of cellulose molecules. Modification could also be realized by physical adsorption of anionic, cationic, or non-ionic substances or any combination of these on cellulose surface. The described modification can be carried out before, after, or during the production of microfibrillar cellulose.

Nanofibrillar cellulose (NFC) can also be called nanocellulose, cellulose nanofiber, nano-scale fibrillated cellulose, microfibrillar cellulose, cellulose nanofibrils (CNF) or microfibrillated cellulose (MFC). In addition, nanofibrillar cellulose produces by certain microbes has also various synonymes, for example, bacterial cellulose, microbial cellulose (MC), biocellulose, nata de coco (NDC), or coco de nata. Nanofibrillar cellulose described in this invention is not the same material as so called cellulose whiskers, which are also known as: cellulose nanowhiskers, cellulose nanocrystals, cellulose nanorods, rod-like cellulose microcrystals or cellulose nanowires. In some cases, similar terminology is used for both materials, for example by Kuth-carlapati et al. (Metals Materials and Processes 20(3):307-314, 2008) where the studied material was called "cellulose nanofiber" although they clearly referred to cellulose nanowhiskers. Typically these materials do not have amorphous segments along the fibrillar structure as nanofibrillated cellulose, which leads to more rigid structure.

Anionic NFC and Cationic NFC

The anionic charge of the anionic NFC can be achieved by chemical or physical modification of the cellulose to anionically charged cellulose. Most commonly used chemical modification methods for making an anionic charge are oxidation and carboxymethylation. The anionic nanofibrillar cellulose is preferably made by disintegration from fibrous raw material where the cellulose has been modified to anionically charged cellulose by chemical or physical modification.

In the oxidation of cellulose to make anionically charged cellulose, the primary hydroxyl groups of cellulose are oxidized catalytically by a heterocyclic nitroxyl compound, for example 2,2,6,6-tetramethylpiperidinyl-1-oxy free radical, "TEMPO". These hydroxyl groups are oxidized to aldehydes and carboxyl groups.

The cationic charge of the cationic NFC can be achieved by chemical or physical modification of the cellulose to cationically charged cellulose. A cationic charge can be created chemically by cationization by attaching a cationic group to the cellulose, such as quaternary ammonium group.

Various grades of the anionic NFC and cationic NFC can also be made by altering the degree of chemical modification. In case of anionic NFC that is made by oxidation, these grades can be expressed as carboxylate content, that is, as mmol COOH/g NFC (based on dry NFC), and in case of anionic NFC that is made by carboxymethylation, as degree of substitution. In the oxidized cellulose the carboxylate content is preferably 0.3-1.5 mmol/g NFC, more preferably 0.6-1.2 mmol/g, and in carboxymethylated NFC, the degree of substitution is preferably 0.05-0.3, more preferably 0.1-0.25. In case of cationic NFC, the degree of substitution is preferably 0.05-0.8, more preferably 0.1-0.5.

The furnish may contain filler in addition to fibres. Filler can be any filler used in paper manufacturing, e.g. precipitated calcium carbonate (PCC), ground calcium carbonate (GCC), kaolin, talcum or gypsum. In the method according to the invention, the filler is added to the furnish in an amount of 1 to 60% by the dry weight of the fibres in the furnish, preferably 2 to 40% by the dry weight of the fibres. Consequently, the filler content of uncoated paper product made of the furnish is 1 to 60%, preferably 2 to 40% calculated on the based on the dry weight of the fibres.

According to one embodiment, the amount of filler in the furnish, as mentioned above, is such that the paper product made from the furnish contains more than 35 wt-% filler, especially more than 40 wt-% filler on dry total weight of uncoated paper. The filler amount can be for example in the range of 40 . . . 50 wt-% on dry total weight of uncoated paper.

The anionic nanofibrillar cellulose is added in an amount of 0.01 to 3.0% by the dry total weight of the furnish, preferably 0.05-1.5%.

The cationic natural polymer is added in an amount of 0.01-3.0% by the dry weight of the furnish, preferably 0.1-1.5%, and most preferably 0.15-1.0%.

The alum is added in an amount of 0.01-0.5% by the dry total weight of the furnish, preferably 0.05-0.3%, and most preferably 0.06-0.25%.

In one embodiment, the above additives are added in amounts which result in the same relative amounts in paper as indicated above, calculated on dry total weight of uncoated paper.

Although the basis weight of the paper product can vary, the basis weight of uncoated paper manufactured from the furnish is preferably 20 . . . 80 g/m$^2$, more preferably 25 . . . 70 g/m$^2$. Thus, the method can be used especially for low basis weight grades, where the retention is important.

FIG. 1 illustrates exemplary methods of the present solution, wherein reference symbol F refers to anionic NFC, reference symbol S refers to cationic natural polymer, such as cationic starch and/or cationic nanofibrillar cellulose, and reference symbol A refers to alum. The arrow refers to the procedure of transferring furnish from stock to a paper machine. The order of adding anionic NFC F, cationically modified polysaccharide S and alum A can vary. These three may be added to furnish at the same time during the process, or S and A may be first added and then last F, or S may be first added, followed by F and finally A. S and A may be added in the short circulation before the furnish is transferred to a headbox feed pump, and F may be added last, after the furnish has passed through a pressure screen. Alternatively, F and A may be added after the furnish has passed through a pressure screen.

The flow of furnish shown in FIG. 1 by arrow contains fibres (papermaking fibres) that will form the structural body of the paper in the form of fibrous network, and optionally filler, all suspended in water. The retention system works in acid or neutral papermaking conditions. The pH of the fibre suspension in acid conditions is normally below 6, whereas in neutral conditions it can be 6-8.5.

The furnish prepared by the method according to the present solution is used for manufacturing of paper or paperboard. In the paper or board machine, the furnish is fed into a forming section and water is removed from the furnish by allowing the furnish to drain through a water permeable forming wire, and after that, the paper or board web thus produced is dried and finished to produce final paper or paperboard with good retention, mechanical strength properties and a high filler content if filler is used.

Thanks to the present solution, a comprehensive retention level, good formation and improved paper properties, such as lower porosity and increased strength properties, can be achieved.

The following examples were carried out to illustrate the present invention. The examples are not intended to limit the scope of the invention.

EXAMPLES

1. Materials 1.1 Furnish was base paper (UPM cote 60 gsm base) which was slushed.

Paper reels of LWC base paper was pulpered and used as a furnish for pilot paper machine. The basis weight of the paper made was 38-41 g/m$^2$.

1.2 c-PAM

Commercial available Fennopol K 3400R (Kemira Oyj, Finland) was used.

1.3 Cationic starch (cationic natural polymer)

Commercial available wet end starch (Raisamyl, Chemigate Oy, Finland) with a typical degree of cationicity (degree of substitution, DS) between 0.015 and 0.06 was used.

1.4 Filler

China clay, also known as kaolin, a typical filler used in paper industry, was used in an amount corresponding the ash target of 5%.

1.5 Anionic nanofibrillar cellulose (NFC)

Primary alcohols of cellulose was oxidized catalytically to aldehydes and carboxylic acids through heterocyclic nitroxyl catalyst mediated (TEMPO) oxidation by using sodium hypochlorite as the main oxidant to obtain oxidized cellulose with 0.82 mmol COOH/g pulp, whereafter the oxidized pulp was disintegrated to NFC.

1.6 Alum

Alum was commercial aluminium sulfate for papermaking, which was added to furnish as solution.

The amounts are indicated on the basis of the total dry substance of the furnish.

2. Tested Samples

Reference sample included 150 g/t c-PAM,

F sample included 150 g/t c-PAM and 8 kg/t anionic oxidized NFC,

FS sample-1 included 150 g/t c-PAM, 8 kg/t anionic oxidized NFC and 8 kg/t cationic starch, FS sample-2 included 8 kg/t anionic oxidized NFC and 8 kg/t cationic starch, and FSA sample included 8 kg/t anionic oxidized NFC, 8 kg/t cationic starch and 2 kg/t Alum.

3. Dosing Procedure

Fresh filler was added to the machine stock batchwise. C-PAM, the anionic NFC, cationic starch and alum were dosed into furnish according to the above mentioned scheme. C-PAM, cationic starch and alum were dosed to machine furnish before the furnish passes the headbox feed pump. The anionic NFC was dosed to the furnish after the furnish passes pressure screens and just before the headbox.

4. Results 4.1 Grammage

Figure 2:
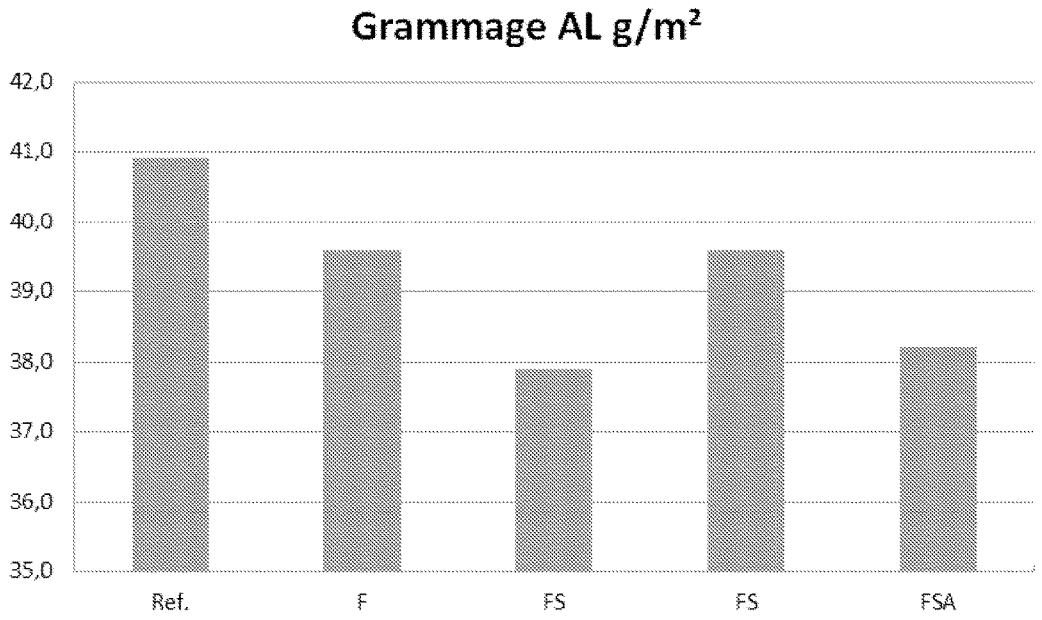
FIG. 2 shows the property of grammage of the paper products manufactured with the furnish containing various ingredients as indicated in the table under the diagram. "FSA" represents the novel retention system in this diagram and in other diagrams.

Paper grammage (basis weight) of paper products made with samples of furnish obtained from the above mentioned procedure is shown in FIG. 2.

4.2 Ash content after burning at 900° C. (sample weight determined before burning and after burning in air-conditioned space).

Figure 3:
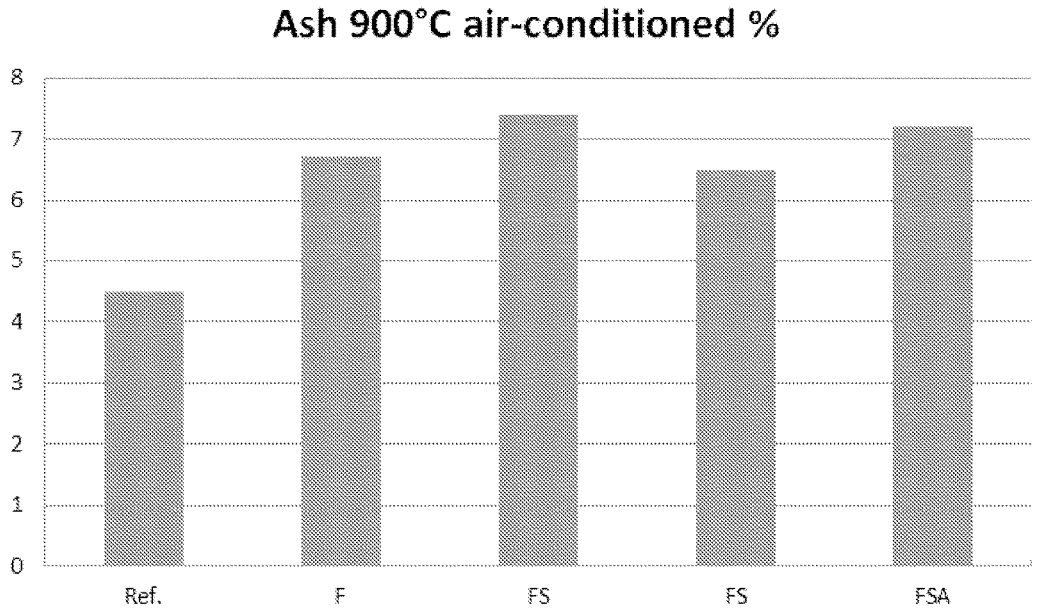
FIG. 3 shows the ash content determined after burning the paper sample made of furnish containing various ingredients as indicated in the table under the diagram.

As shown in FIG. 3, adding any of cationic starch, alum and anionic nanofibrillar cellulose improved the ash content, compared with the sample having only c-PAM.

4.3 Total retention

Figure 4:
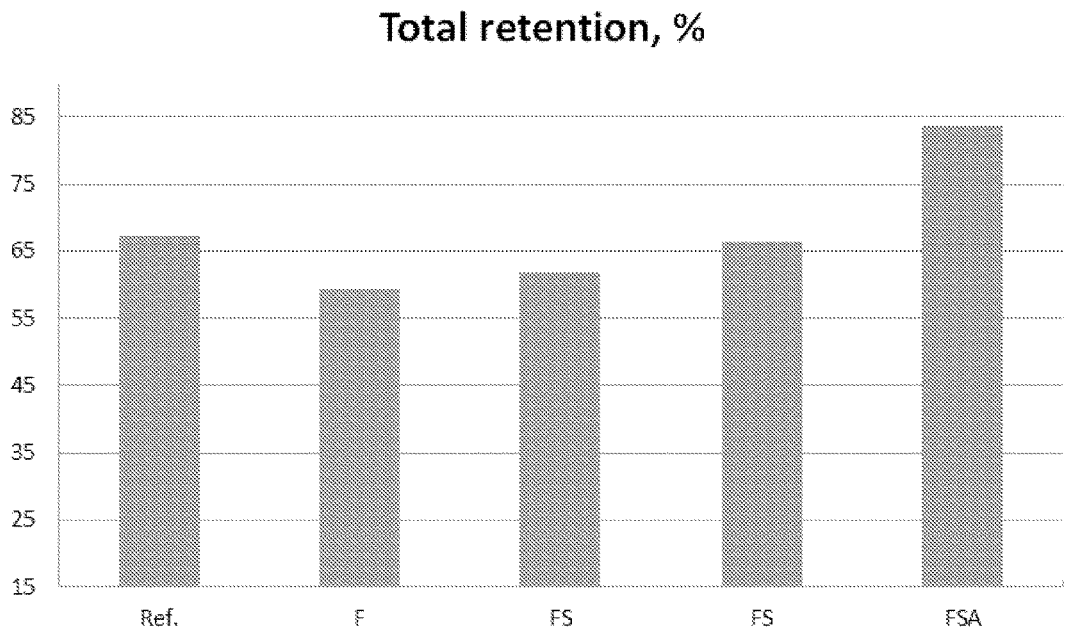
FIG. 4 shows the total retention content of the furnish containing various ingredients as indicated in the table under the diagram.

Total retention of samples made of furnish obtained by the above mentioned procedure is shown in FIG. 4. A significant improvement in total retention, compared with samples containing no alum, was observed in FSA sample.

Total retention of close to 85% was achieved.

4.4 Retention of nanofibrillar cellulose

Figure 5:
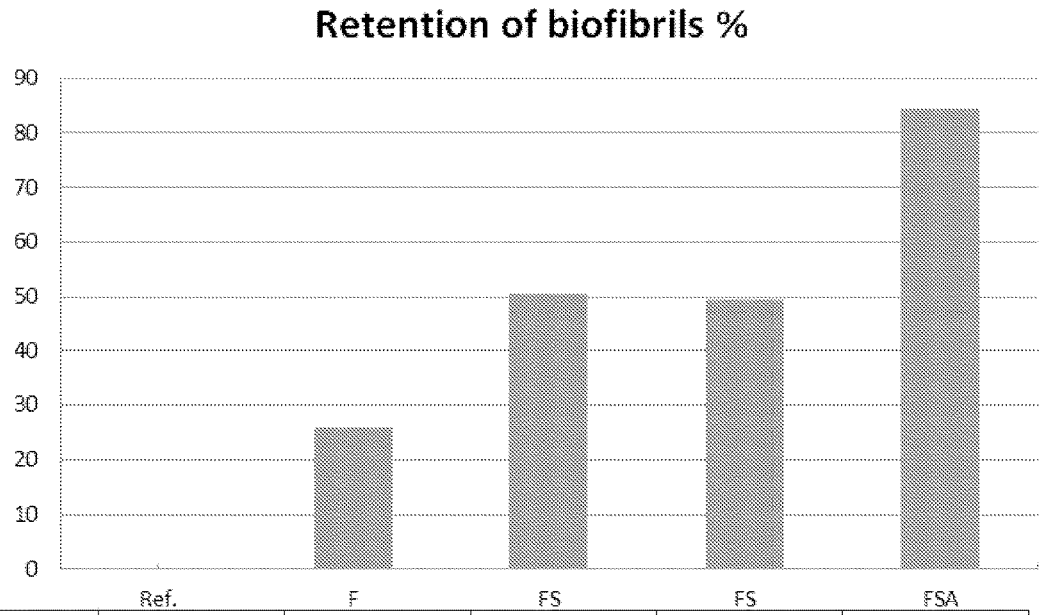
FIG. 5 shows the retention content of nanofibrillar cellulose ("biofibrils") of the furnish containing various ingredients as indicated in the table under the diagram.

Retention of nanofibrillar cellulose of samples made of furnish obtained by the above mentioned procedure is shown in FIG. 5. Again, a significant improvement in retention of nanofibrillated cellulose, compared with samples containing no alum, was observed in FSA sample. Retention of around 85% was achieved.

4.5 Internal bond strength

Figure 6:
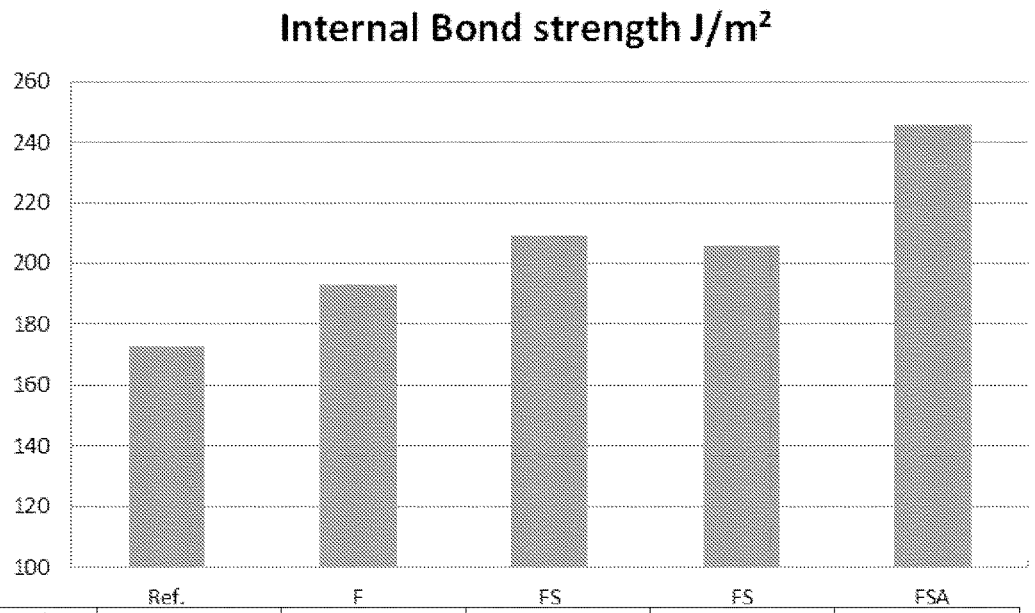
FIG. 6 shows the internal bond strength of the paper made of furnish containing various ingredients as indicated in the table under the diagram.

Internal bond strength of samples made of furnish obtained by the above mentioned procedure is shown in FIG. 6. Again, a significant improvement in internal bond strength, compared with samples containing no alum, was observed in FSA sample. Internal bond strength of more than 240 $J/m^2$ was achieved at basis weights of 38-41 $g/m^2$, whereas the other samples remained under 220 $J/m^2$.

4.6 Tensile strength index GA (geometric average of values in machine direction and cross direction)

Figure 7:
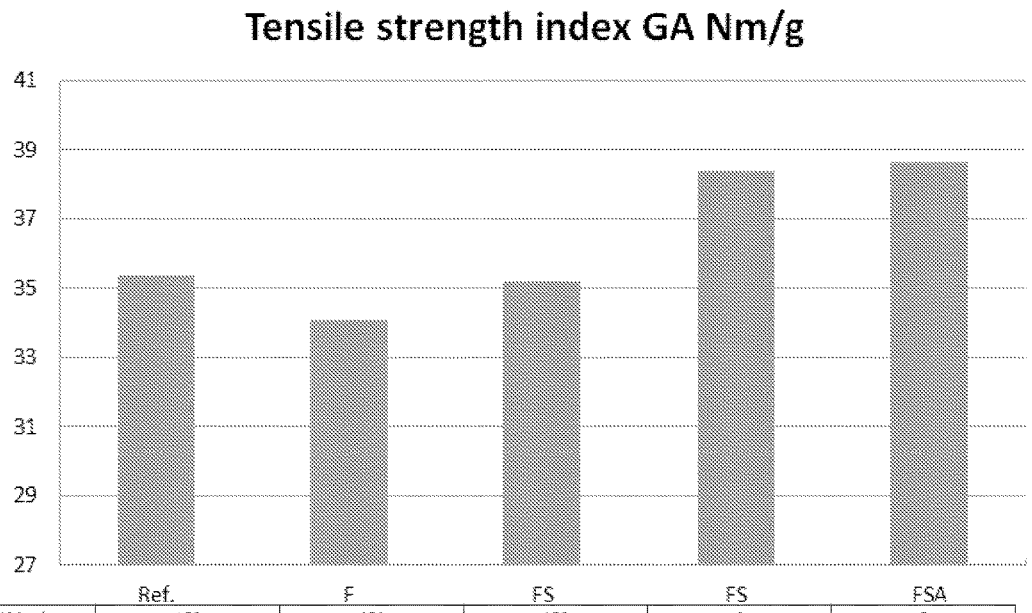
FIG. 7 shows the tensile strength index of the paper made of furnish containing various ingredients as indicated in the table under the diagram.

Tensile strength index of samples made of furnish obtained by the above mentioned procedure is shown in FIG. 7. A significant improvement in tensile strength index, compared with samples containing c-PAM, was observed in FS and FSA sample. Tensile strength index was even slightly better in FSA sample than in FS sample, close to 39 Nm/g.

4.7 Strain at break and (machine direction)

Figure 8:
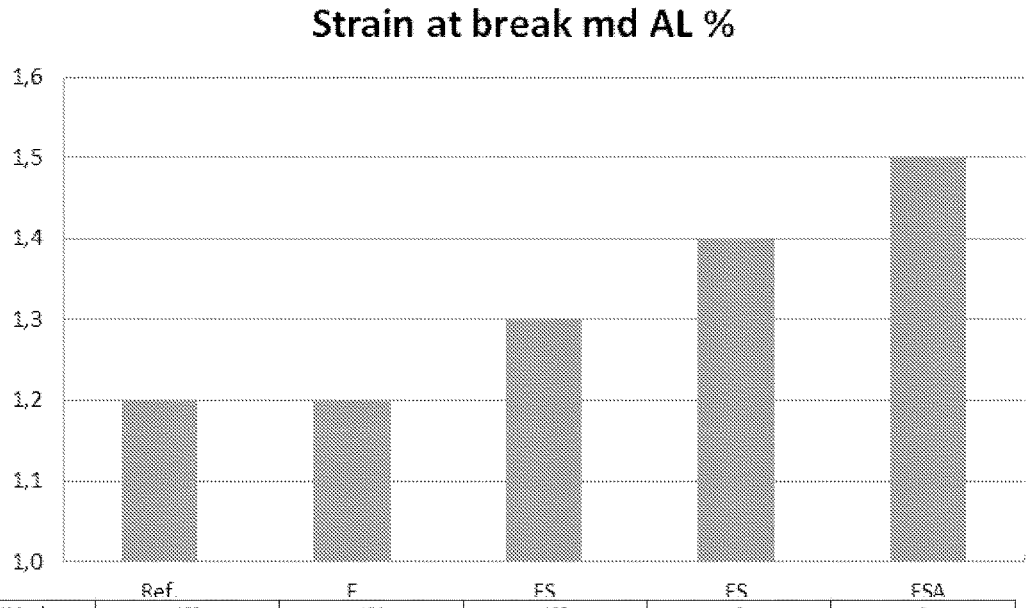
FIG. 8 shows the strain at break of the paper in machine direction (md) made of furnish containing various ingredients as indicated in the table under the diagram.

Strain at break of samples made of furnish obtained by the above mentioned procedure is shown in FIG. 8. Again, a significant improvement in strain at break, compared with samples containing no Alum, was observed in FSA sample. Strain at break of around 1.5% was achieved.

4.8 Formation (normalized standard deviation, beta-formation)

Figure 9:
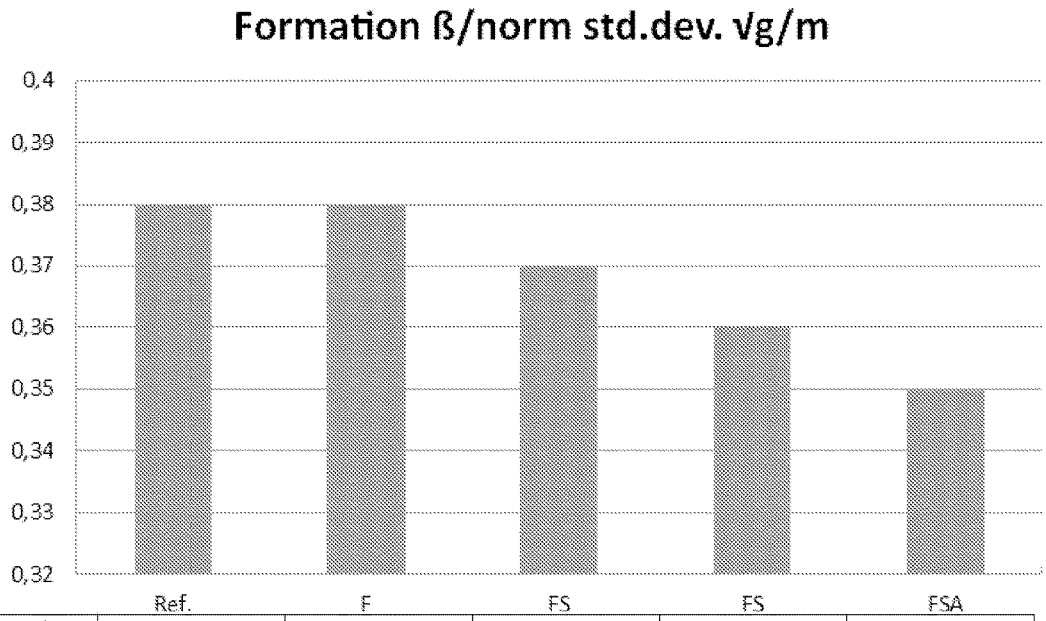
FIG. 9 shows the formation of the paper made of furnish containing various ingredients as indicated in the table under the diagram.

Formation of samples of furnish obtained from the above mentioned procedure is shown in FIG. 9. Formation problem in form of strong flocculation caused by c-PAM was alleviated in samples containing cationic starch. Even less strong flocculation, around 0.35 (square root g)/m, was achieved in FSA sample.

4.9 Air permeance Bendtsen ml/min

Figure 10:
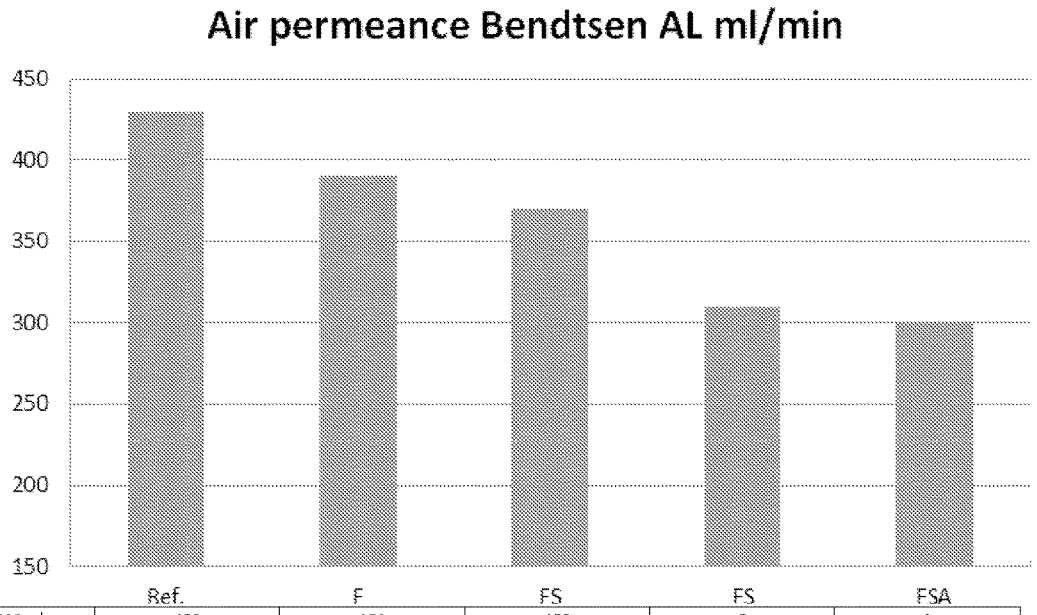
FIG. 10 shows the air permeance Bendtsen of the paper made of furnish containing various ingredients as indicated in the table under the diagram.

Air permeance Bendtsen of samples of furnish obtained from the above mentioned procedure is shown in FIG. 10. A significant improvement in air permeance Bendtsen, compared with samples containing c-PAM, was observed in FS and FSA sample. Air permeance Bendtsen was even slightly better in FSA sample than in FS sample, around 300 ml/min.

4.10 Linear relationships

Figure 11:
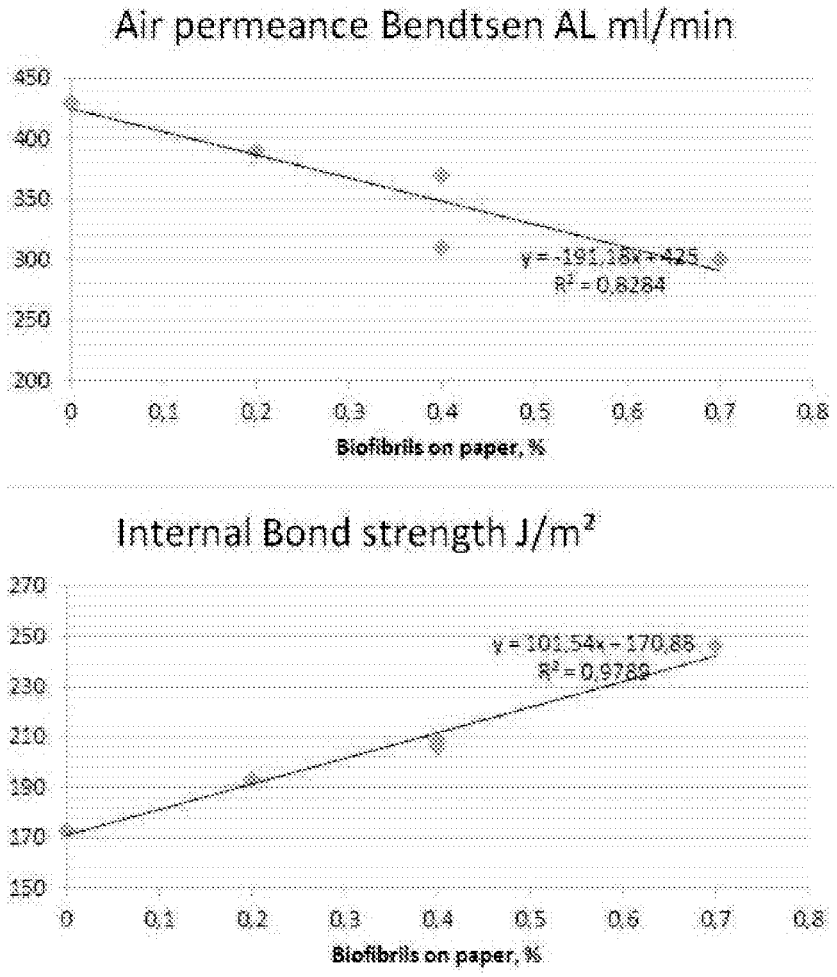
FIG. 11 shows the linear relationship between the content of nanofibrillar cellulose in paper and air permeance Bendtsen (upper diagram) and the linear relationship between the content of nanofibrillar cellulose in paper and internal Bond strength (lower diagram)

FIG. 11 shows the linear relationship between the measured content of nanofibrillated cellulose in paper and air permeance Bendtsen (upper diagram) and the linear relationship between the measured content of nanofibrillar cellulose in paper and internal Bond strength (lower diagram).

Cationic NFC as Retention Agent

Cationic starch was replaced by cationic nanofibrillar cellulose (degree of substitution 0.2-0.3). Total retention and ash retention was evaluated In the point showing the highest retention, the amount of both cationic NFC and anionic NFC was 2%, as shown by FIGS. 12 and 13, the wire retention and ash retention being over 90%.

Figure 12:
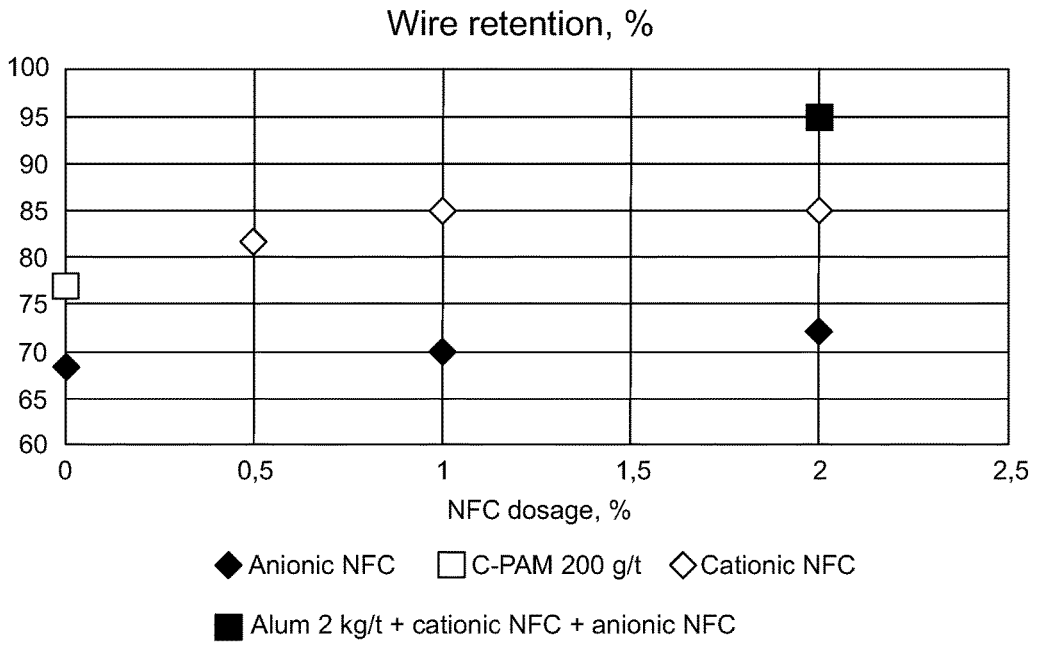
FIGS. 12 and 13 show the wire retention and ash retention in tests where cationic NFC was used as cationic natural polymer instead of cationic starch in the furnish.
Figure 13:
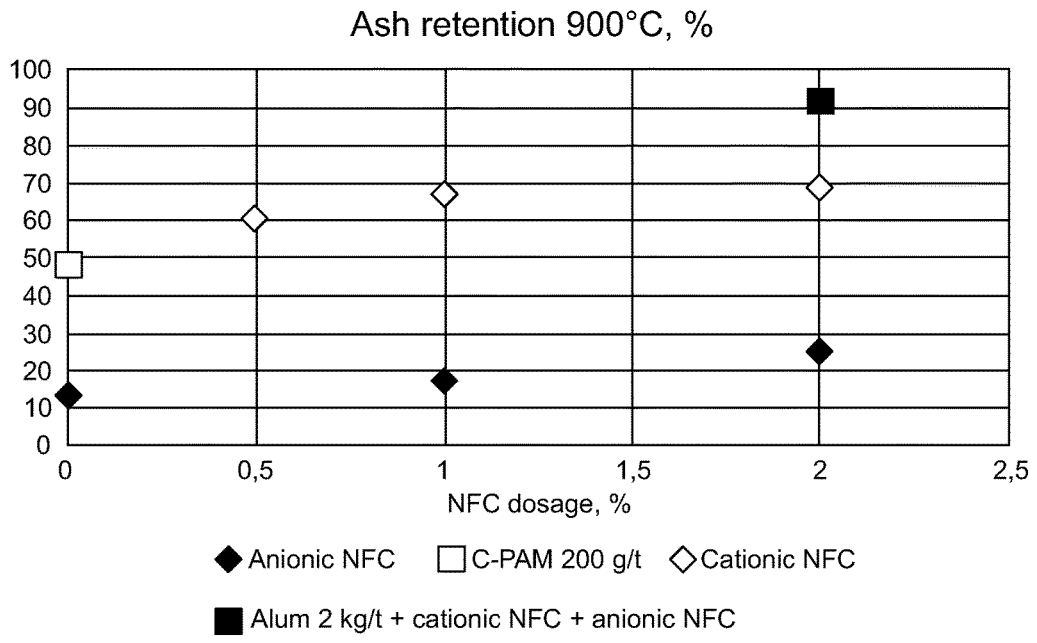

Based on the results shown in FIGS. 12 and 13, the furnish containing alum+cationic NFC+anionic NFC performed clearly better than normal C-PAM based retention system. The figures also show the effect of increasing NFC dosage on the retention. The cationic NFC can be used in lower amounts than 2% as the cationic natural polymer in the retention system together with the alum and anionic NFC, the amounts of 0.2%-0.5% being sufficiently high.

The invention claimed is:

1. A method for preparing aqueous furnish to be used in paper product manufacturing, in which method aqueous furnish is prepared by making a fibre suspension, and cationic natural polymer, alum and anionic nanofibrillar cellulose are added to the aqueous furnish in a short circulation of a paper or board machine; wherein alum is added before anionic nanofibrillar cellulose is added.

2. The method according to claim 1, wherein the cationic natural polymer and alum are added, in either order or simultaneously, before anionic nanofibrillar cellulose is added.

3. The method according to claim 2, wherein alum is added before the fibre suspension is transferred to a feed pump in a paper machine, and the anionic nanofibrillated cellulose is added to the fibre suspension after the fibre suspension has passed through a pressure screen.

4. The method according to claim 3, wherein the cationic natural polymer is added, before, after or simultaneously with the alum, before the fibre suspension is transferred to a feed pump in a paper machine.

5. The method according to claim 1, wherein the cationic natural polymer is added before anionic nanofibrillar cellulose is added, followed by adding alum.

6. The method according to claim 5, wherein the cationic natural polymer is added before the aqueous furnish is transferred to a feed pump in a paper machine, and alum and anionic nanofibrillar cellulose are added to the aqueous furnish after the aqueous furnish has passed through a pressure screen in a paper machine.

7. The method according to claim 1, wherein the cationic natural polymer is cationically modified polysaccharide, such as cationic starch or cationic nanofibrillar cellulose.

8. The method according to claim 1, wherein the fibre suspension comprises filler.

* * * * *